US008080512B2

(12) United States Patent
Pawar

(10) Patent No.: US 8,080,512 B2
(45) Date of Patent: Dec. 20, 2011

(54) PROCESS FOR PREPARING A DETERGENT

(75) Inventor: Jagdish Pawar, Pune (IN)

(73) Assignee: J P Laboratories Pvt. Ltd., Pune (IN)

( * ) Notice: Subject to any disclaimer, the term of this patent is extended or adjusted under 35 U.S.C. 154(b) by 287 days.

(21) Appl. No.: 11/631,776

(22) PCT Filed: Dec. 23, 2004

(86) PCT No.: PCT/GB2004/005426

§ 371 (c)(1),
(2), (4) Date: Aug. 21, 2007

(87) PCT Pub. No.: WO2006/067360

PCT Pub. Date: Jun. 29, 2006

(65) Prior Publication Data

US 2007/0298993 A1 Dec. 27, 2007

(51) Int. Cl.
*C11D 11/00* (2006.01)
*C11D 1/12* (2006.01)

(52) U.S. Cl. ..... 510/457; 510/443; 510/444; 510/452; 510/495

(58) Field of Classification Search ..... 510/457, 510/443, 444, 452, 495
See application file for complete search history.

(56) References Cited

U.S. PATENT DOCUMENTS

| | | | | | |
|---|---|---|---|---|---|
| 2,178,786 | A | * | 11/1939 | Fasce et al. | 558/41 |
| 2,337,552 | A | | 12/1943 | Henke | |
| 2,522,212 | A | * | 9/1950 | Dammers | 510/432 |
| 4,054,541 | A | * | 10/1977 | Mausner et al. | 510/135 |
| 4,129,526 | A | * | 12/1978 | Ogoshi et al. | 510/443 |
| 4,253,993 | A | * | 3/1981 | Ramsey et al. | 510/120 |
| 4,534,879 | A | * | 8/1985 | Iding et al. | 510/192 |
| 4,652,391 | A | * | 3/1987 | Balk | 510/356 |
| 4,874,536 | A | * | 10/1989 | Strickland et al. | 510/192 |
| 4,999,138 | A | * | 3/1991 | Nebashi et al. | 510/324 |
| 5,338,476 | A | * | 8/1994 | Pancheri et al. | 510/352 |
| 5,698,511 | A | * | 12/1997 | Scherr et al. | 510/452 |
| 5,726,142 | A | * | 3/1998 | Partee et al. | 510/276 |
| 5,905,034 | A | * | 5/1999 | Ali | 435/253.5 |
| 5,962,397 | A | * | 10/1999 | Ridyard et al. | 510/443 |

FOREIGN PATENT DOCUMENTS

| | | | | |
|---|---|---|---|---|
| DE | 1131662 | | | 6/1962 |
| EP | 1 491 619 | A1 | | 12/2004 |
| EP | 1 491 619 | B1 | | 1/2005 |
| GB | 2142341 | A | * | 1/1985 |
| JP | 62220597 | | | 9/1987 |
| JP | 62220597 | A | * | 9/1987 |
| JP | 2000109895 | | | 4/2000 |
| JP | 2000109895 | A | * | 4/2000 |
| RO | 110347 | | | 12/1995 |

OTHER PUBLICATIONS

RD 309011A, Jan. 10, 1990 (Research Disclosure).*
Matalon, R. "Precipitation of Sodium Dodecyl Sulfate from Aqueous Solution by the Addition of Sodium Chloride", Memorial des Services Chimiques de l'Etat (1953), vol. 38 (No. 2), pp. 135-138. (Abstract Only).*

* cited by examiner

*Primary Examiner* — Lorna M Douyon
(74) *Attorney, Agent, or Firm* — Marshall, Gerstein & Borun LLP

(57) ABSTRACT

Disclosed is a process for preparing a granular detergent composition or component having a bulk density of at least 500 g/l. The process disclosed herein comprises the steps of (i) providing an aqueous solution of a surfactant (ii) adding one or more water-soluble salts to the aqueous surfactant solution to precipitate the surfactant, (iii) separating the resulting precipitate, and (iv) drying the product.

14 Claims, No Drawings

PROCESS FOR PREPARING A DETERGENT

CROSS-REFERENCE TO RELATED APPLICATIONS

This is the U.S. national phase application of International Application No. PCT/GB2004/005426, filed Dec. 23, 2004.

TECHNICAL FIELD

THE PRESENT INVENTION relates to cleaning compositions, and more particularly to processes for preparing granular detergent compositions having relatively high bulk density.

BACKGROUND

There has been considerable interest in the detergent industry in the development of cleaning compositions having a relatively high bulk density, typically 500 g/l and above. Such high bulk density compositions are of interest in industry as they facilitate the production of detergent compositions having a low dosage volume, with the associated conservation of resources.

In general there are two main types of process by which detergent granules or powders are prepared. The first involves spray-drying an aqueous detergent slurry in a spray-drying tower, wherein the detergent active is dried by atomising it and spraying it into a stream of air at a high temperature. There has been considerable research and development into spray-drying process for the production of detergent compositions, for example, see the processes described in EP 360275, GB 2231579, WO 99/19453 and U.S. Pat. No. 4,524,010.

The second type of process involves dry mixing the detergent components, and subsequently agglomerating the dry-mixed components in high or medium speed mixer/densifier, typically in the presence of a liquid binder, such as water, a non-ionic or an anionic surfactant.

In practice spray-dried detergent compositions have been found to have relatively low bulk density. Spray-drying processes require expensive and complicated machinery and involve relatively high energy consumption. Furthermore, spray-drying processes typically result in the production of fine particles of the detergent composition, with the associated problems with regard to air pollution.

Detergent compositions having medium to high bulk densities have been produced by dry-mix agglomeration processes. However detergents produced by such dry-mix processes have been found to suffer from a number of problems, including poor dispersion properties and unsatisfactory detergent performance, as discussed in U.S. Pat. No. 6,303,558. Dry-mix processes also require the use of hi-tech mixer/densifier equipment.

Accordingly, there remains a need for alternative processes for the production of granular cleaning compositions having a relatively high bulk density. Also, there remains a need for such a process which is efficient and economical to facilitate large-scale production of granular cleaning compositions having a relatively high bulk density.

The inventors of the present Application have found that granular cleaning compositions having a relatively high bulk density may be prepared by a process involving adding water-soluble salts to an aqueous solution of a surfactant compound. The process disclosed herein allows the preparation of a granular cleaning composition without the requirement for expensive spray-drying or mixer/densifier equipment.

SUMMARY OF THE INVENTION

According to the present invention there is provided a process for the production of a high bulk density granular detergent composition or component having a bulk density of at least 500 g/l, comprising the steps of;

(i) providing an aqueous solution of a surfactant, (ii) adding one or more water-soluble salts to the aqueous surfactant solution to precipitate the surfactant, (iii) separating the resulting precipitate, and, finally;

(iv) drying the product.

Preferably the surfactant is an anionic surfactant, and more preferably the surfactant is Sodium Laurel Sulphate.

Conveniently at least one water-soluble salt is chosen from the group consisting of potassium nitrate, potassium chloride, potassium acetate, sodium acetate, sodium chloride, barium chloride, or any combination thereof.

Preferably at least one water-soluble salt is a sea salt.

Conveniently the separation of the precipitate in step (iii) is effected with a filtration apparatus or centrifuge.

Preferably the separation of the precipitate is effected with a filter press.

Conveniently the product may be dried in step (iv) in a fluid bed dryer, drum vacuum dryer, tray dryer, or any combination thereof.

According to one aspect of the present invention one or more additives may be advantageously added to the separated precipitate formed in step (iii) before drying, to form detergents or cleaning compositions having desired properties.

Conveniently one or more of the additives are chosen from the group consisting of detergency builders, fillers, acid powders, alkali powders, binders, bleaches, bleach activators, fluorescers, anti-tarnish agents, anti-corrosion agents, soil-suspending agents, soil-release agents, germicides, Ph adjusting agents, chelating agent, clays, coating agents, enzymes, enzyme stabilising agents or any combination thereof.

Preferred additives include acid powders and alkali powders.

The process described herein allows the preparation of relatively high bulk density granular surfactant, detergent or cleaning compositions, without the need for expensive spray-drying, or mixer/densifier equipment.

DETAILED DESCRIPTION OF THE INVENTION

The present invention is concerned with the preparation of a relatively high bulk density detergent composition or component by means of a precipitation process which involves the addition of a water-soluble salt to an aqueous surfactant solution.

One or more surfactant components may be used in the present process. Preferred surfactants for use in the process of the invention include anionic surfactants. Exemplary anionic surfactants include alkyl sulphates and alky alkoxy sulphates, particularly those of sodium.

A preferred surfactant is Sodium Laurel Sulphate (SLS). Sodium Laurel Sulphate is widely used in the detergent industry as an active component in a wide variety of cleaning compositions, such as, for example, washing powders, soap based products and shampoos.

The aqueous surfactant solution according to the process of the present invention preferably has a concentration of 5 to 40% (w/v), preferably 10 to 35% (w/v) and more preferably 20 to 30% (w/v). The aqueous surfactant solution for use in the present process may be prepared by any suitable method. Suitable methods for the preparation of the aqueous surfactant solution will be evident to the person skilled in the art, with respect to the particular surfactant selected.

Where the surfactant Sodium Laurel Sulphate is used, the aqueous surfactant solution may conveniently, be prepared by a sulphonation process. Suitable conditions for carrying out such a sulphonation process will be known to the person skilled in the art. The sulphonation process may be either a continuous or batch type processes. Continuous sulphonation processes will typically produce aqueous solution of Sodium Laurel Sulphate with a concentration of around 70% (w/v). Batch processes will typically produce an aqueous solutions with a lower concentration of Sodium Laurel Sulphate, typically around 30% to 60% (w/v). Concentrated aqueous solution of Sodium Laurel Sulphate produced in this way can then be diluted to the desired concentration for use in the present process. The concentrated aqueous solution of Sodium Laurel Sulphate may be prepared in-situ, or is readily available from manufacturers. Alternative methods for the production of aqueous solution of Sodium Laurel Sulphate will be evident to the person skilled in the art.

In the second step of the process one or more water-soluble salts are added to the aqueous surfactant solution to induce precipitation. Salts contemplated for use in this step include organic and inorganic salts.

The amount of salt to be added to the aqueous solution of surfactant must be an amount sufficient to effect precipitation of the surfactant from solution. The amount of salt required to effect precipitation in any given case can be easily determined be the person skilled in the art using standard procedures.

Specifically, it has been observed that the surfactant Sodium Laurel Sulphate is highly soluble in water, but only poorly soluble in aqueous salt solution. It has been found that increasing the concentration of salt in the aqueous solution results in decrease in the solubility of the surfactant compound. With respect to the surfactant Sodium Laurel Sulphate, it has been observed that Sodium Laurel Sulphate is slightly soluble in an aqueous salt solution having a salt concentration of up to about 3% (w/v), and is progressively more insoluble on increase of the salt concentration. It has been observed that Sodium Laurel Sulphate is almost completely insoluble in an aqueous salt solution having a salt concentration of 5% (w/v). Where the surfactant Sodium Laurel Sulphate is used, the amount of salt added may usefully be an amount to provide aqueous solution having a salt concentration of 5% (w/v) or more, preferably 10% (w/v) or more.

It is important that sufficient salt be added in order to induce precipitation. If sufficient salt is not added separation may not be achieved and a paste may be formed comprising surfactant and salt components.

The salt may conveniently be added to the aqueous solution of surfactant at room temperature. Preferably the aqueous solution is mixed or agitated on addition of the salt.

Preferred salts for use in the process include potassium nitrate, potassium chloride, barium chloride, sodium chloride, sodium acetate, potassium acetate or combinations thereof. It has been found that variation of the salt added to the aqueous solution of a particular surfactant, for example Sodium Laurel Sulphate, results in variations in the physical characteristics, e.g. density, particle size, shape and form of the resultant granular product.

One or more salts may be used to obtain desired particle size, density, shape and form.

Particularly preferred salts for use in the process include salts from natural sea water. Sea salts contain a mixture of natural salts, the major component being sodium chloride. It has been found that granular product having a bulk density of over 500 can be achieved using sea salts. Sea salts have the advantages of being cheap and readily available by evaporation of sea water.

The particular method used for separating the surfactant precipitate is not important. Any simple separation method may conveniently be used, for example, filtration methods e.g. filter press, vacuum filtration, or with a centrifuge. The use of a filter press is particularly suitable for producing a separated precipitate having a low moisture content.

On separation a wet cake of the surfactant precipitate is formed. The separated precipitate preferably has a moisture content of 5% to 35% (w/w).

If desired, after separation of the surfactant precipitate, the aqueous salt solution can be concentrated and the salts recovered by known methods. For example, simple solar evaporation methods can be conveniently be used for recovery of many salts, particularly where sea salts are used. In this way the salt solution by-product can be recycled, with the associated economic and environmental advantages.

Optionally one or more additives may be added to the separated surfactant precipitate before drying.

Of particular interest are high density powders, liquid additives or fillers which can be added to produce detergent compositions having a higher bulk density than dried granules of surfactant composition alone, for instance to obtain granules with a high bulk density of over 700 g/l, and/or to provide variation in the particle size, form or shape of the resultant granular detergent product.

Also acidic powders, such as Picric acid, para toluene sulphonic acid and/or alkaline powders, such as sodium carbonate, or sodium bicarbonate, can be added to enhance the dissolution and foaming properties of the detergent composition. It has been found that, where a mixture of alkaline and acidic powders are added, as additives, the product detergent composition liberates carbon dioxide gas in aqueous media, improving the solubility and dispersion properties of the detergent composition.

In general, any standard detergent additives can be added to provide granular detergent composition having desired properties. Preferred additives include fillers, detergency, builders, acid powders, alkali powders, binders, bleaches, bleach activators, fluorescer anti-tarnish agents, anti-corrosion agents, soil-suspending agents, soil-release agents, germicides, Ph adjusting agents, chelating agents, clays, coating agents, enzymes, enzyme stabilising agents or any combination thereof. Other suitable additives will be well known to the person skilled in the art.

Drying of the product in step (iv) can be carried out in any simple dryer. Examples of suitable simple dryers include fluid bed dryers, tray dryers or drum vacuum dryers. Other suitable dryers will be known to the skilled person. It has been found that granular product having a moisture content in the range of 0.5%-2% (w/w) can be achieved using a vacuum dryer.

Drying the wet-cake of surfactant in this manner requires a considerable lower energy consumption than that used in many conventional processes for the drying of surfactant slurry or aqueous solution (e.g spray-dry methods).

The process according to the present invention allows the production of high bulk density granular free-flowing detergent component or composition having a bulk density of at least 500 g/l. The process of the invention provides an economic and efficient method for the preparation of high bulk density, free-flowing granular detergent compositions. The process allows the production of granular products having a range of desired bulk densities, particle sizes, shapes and forms, which can be used in a variety of detergent and cleaning composition applications.

The use of the method of the present invention for the manufacture of granular detergent compositions allows the production of fine particles of detergent composition to be avoided, with the associated safety and environmental advantages.

The process of the invention can be used to provide granules of surfactant, in particular Sodium Laurel Sulphate having a bulk density in the range of between 500 to 710 g/l.

The process of the present invention avoids the need for complicated and expensive equipment, and provides an economical and energy-efficient process for the manufacture of low dosage volume, compact granular surfactant and detergent compositions. Additionally the aqueous salt solution by-product produced in the process of the present invention as described can be recycled, recovering the corresponding salts.

The invention is further illustrated by the following non-limiting examples.

EXAMPLES

Example 1

To 100 ml of a 20% (w/v) solution of Sodium Laurel Sulphate at room temperature 10 g of barium chloride were added with continuous stirring. The mixture was agitated for two hours. Precipitated granules of Sodium Laurel Sulphate were observed at the bottom of the vessel. The precipitate was filtered under vacuum, producing a wet cake of Sodium Laurel Sulphate. The wet cake of Sodium Laurel Sulphate was dried under vacuum and the properties of the resultant Sodium Laurel Sulphate granules were determined as follows:—

| | |
|---|---|
| Density: | 710 g/l (measured using standard tap density apparatus) |
| Particle size: | 100 micron - 50% |
| | 50 micron - 20% |
| | 30 micron - 30% |
| Shape/form: | rounded/globular granules |

(Particle size determined by visual microscopic method)

Examples 2 to 6

The process was carried out as in Example 1 with the addition of the different salts as shown in Table 1 below to 100 ml of 20% (w/v) solution of Sodium Laurel Sulphate:

| Salt (10 g) | Bulk density of granules (g/l) |
|---|---|
| Potassium nitrate | 700 |
| Potassium chloride | 680 |
| Potassium acetate | 620 |
| Sodium acetate | 590 |
| Sodium chloride | 550 |

Sodium Laurel Sulphate has the systematic name Sodium Dodecyl Sulphate and is also known as "Sodium Lauryl Sulphate".

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A process for preparing a granular detergent composition or component consisting of:

(i) providing a 5% to 40% (w/v) aqueous solution of sodium lauryl sulphate, (ii) adding a solution containing 5% w/v or more of one or more water-soluble salt to the aqueous sodium lauryl sulphate solution to precipitate the sodium lauryl sulphate, (iii) separating the resulting precipitate from the one or more water-soluble salts, and (iv) adding one or more additives to the separated precipitate before drying, and (v) drying the precipitate to provide a granular detergent having a bulk density of at least 500 g/l.

2. The process according to claim 1, wherein at least one water-soluble salt is selected from the group consisting of potassium nitrate, potassium chloride, potassium acetate, sodium acetate, sodium chloride, and any combination thereof.

3. The process according to claim 1 wherein at least one water-soluble salt is sea salt.

4. The process according to a claim 1 wherein the precipitate is separated in step (iii) with a filtration apparatus or centrifuge.

5. The process according to claim 1 wherein the product is dried in step (v) in a fluid bed dryer, drum vacuum dryer, tray dryer, or any combination thereof.

6. The process according to claim 1, wherein the one or more additives are selected from the group consisting of detergency builders, fillers, acid powders, alkali powders, binders, bleaches, bleach activators, fluorescers, anti-tarnish agents, anti-corrosion agents, soil-suspending agents, soil-release agents, germicides, pH adjusting agents, chelating agents, clays, coating agents, enzymes, enzyme stabilising agents, and combinations thereof.

7. The process according to claim 6, wherein the additives include an acid powder and an alkali powder.

8. The process according to claim 1 wherein the aqueous solution of sodium lauryl sulphate is 10 to 35% (w/v).

9. The process according to claim 1 wherein the aqueous solution of sodium lauryl sulphate is 20 to 30% (w/v).

10. The process according to claim 1 wherein the water-soluble salt solution is 10% (w/v) or more.

11. A process for preparing a granular detergent composition or component comprising:

(i) providing a 5% to 40% (w/v) aqueous solution of sodium lauryl sulphate, (ii) adding a solution containing 5% w/v or more of one or more water-soluble salt selected from the group consisting of potassium nitrate, potassium chloride, potassium acetate, sodium acetate, barium chloride, and any combination thereof to the aqueous sodium lauryl sulphate solution to precipitate the sodium lauryl sulphate, (iii) separating the resulting precipitate from the one or more water-soluble salts, and (iv) drying the precipitate to provide a granular detergent having a bulk density of at least 590 g/l.

12. The process according to claim 11 further comprising a step of adding one or more additives to the separated precipitate before drying.

13. The process according to claim 12, wherein the one or more additives are selected from the group consisting of detergency builders, fillers, acid powders, alkali powders, binders, bleaches, bleach activators, fluorescers, anti-tarnish agents, anti-corrosion agents, soil-suspending agents, soil-release agents, germicides, pH adjusting agents, chelating agents, clays, coating agents, enzymes, enzyme stabilising agents, and combinations thereof.

14. The process according to claim 13, wherein the additives include an acid powder and an alkali powder.

* * * * *